United States Patent [19]

Davis

[11] 4,334,601

[45] Jun. 15, 1982

[54] UTILITY BAG

[75] Inventor: Johnnie G. Davis, Mexico, Mexico

[73] Assignee: The Coca-Cola Company, Atlanta, Ga.

[21] Appl. No.: 156,644

[22] Filed: Jun. 5, 1980

[51] Int. Cl.[3] ..... A45C 7/00

[52] U.S. Cl. ..... 190/44; 190/52

[58] Field of Search ..... 190/44, 52, 21, 43; 150/2.1, 2.2, 2.5, 52 A, 52 G, 52 J, 33; 224/151, 258

[56] References Cited

U.S. PATENT DOCUMENTS

| | | | |
|---|---|---|---|
| 1,510,815 | 10/1924 | Adams | 190/44 X |
| 3,122,225 | 2/1964 | Ward | 190/52 |
| 3,428,103 | 2/1969 | Walsh | 150/2.2 |
| 4,090,593 | 5/1978 | Koff | 190/51 X |
| 4,210,186 | 7/1980 | Belenson | 190/52 X |

FOREIGN PATENT DOCUMENTS

| | | | |
|---|---|---|---|
| 1474951 | 2/1967 | France | 190/44 |
| 2374866 | 8/1978 | France | 190/44 |

*Primary Examiner*—Donald F. Norton

*Attorney, Agent, or Firm*—Birch, Stewart, Kolasch and Birch

[57] ABSTRACT

A multiple compartment utility bag is provided having an insulated central compartment and two end compartments of which at least one is capable of being either expanded or retained in an unexpanded contracted condition. An arrangement of slide fasteners is provided for access to the end compartments and peripheral to the one end compartment to expand. Carrying handles and shoulder or tote strap means are provided to thereby permit the conversion of the bag to hand or shoulder carrying modes. Further, the carrying handles are arranged in a sling configuration around the central section as to reinforce the sides and bottom walls of the carrying case to enhance its durability.

11 Claims, 7 Drawing Figures

UTILITY BAG

FIELD OF THE INVENTION

This invention relates to utility bag structures and more particularly to a utility bag structure having a main central compartment section which is thermally insulated and which further includes both hand carrying and shoulder strap configurations together with end compartments, one of which is extensible to convert the bag from a first to a second size.

OBJECT OF THE INVENTION

It is an object of the present invention to provide a new and novel utility bag structure.

Another object of the present invention is to provide a new and novel utility bag structure having an extensible end compartment in combination with a thermally insulated central compartment and a second end compartment and which is readily convertible from a hand carry to a shoulder carry mode.

Still another object of the present invention is to provide a new and novel utility bag structure of the convertible carry mode type which includes end walls capable of readily displaying promotional indicia and the like.

Yet another object of the present invention is to provide a new and novel utility bag structure capable of carrying beverages or the like in a thermally insulated manner while at the same time being expandable for the purpose of carrying sports equipment and clothing and the like.

These and other objects of the present invention will become more fully apparent with reference to the following specifications of the present invention.

BRIEF DESCRIPTION OF THE DRAWINGS

FIG. 5 is an end view of the utility bag of the present invention indicating the nature of the end walls of the end compartments and the adaptability thereof to the receipt of promotional indicia and the like;

SUMMARY OF THE INVENTION

Figure 1:
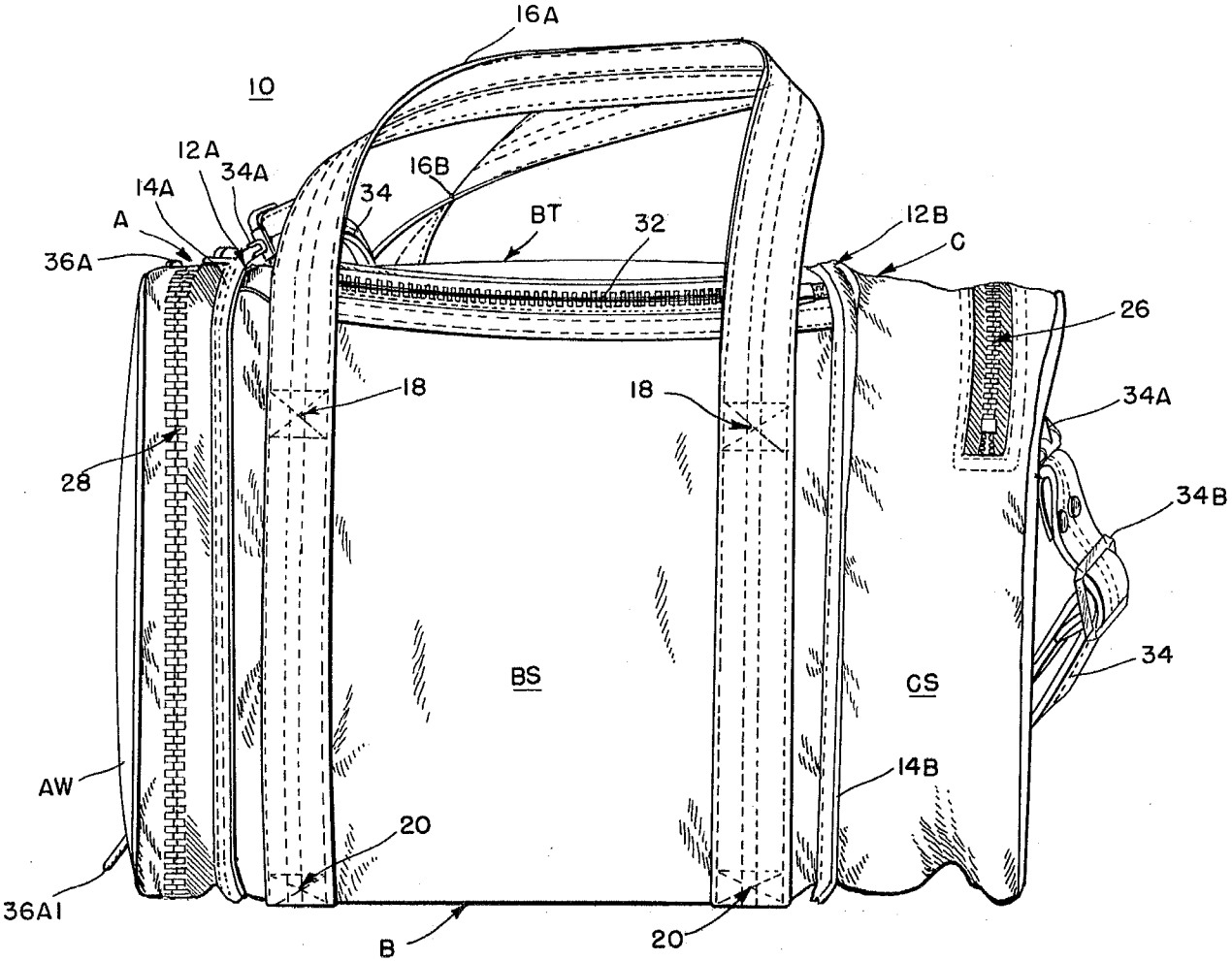
FIG. 1 is a side elevation of the utility bag of the present invention.

The utility bag of the present invention is provided with a central thermally insulated compartment having hand carry loops arranged in a sling configuration down the side walls and across the bottom thereof leaving free hand carry loops which are joinable together across the top of that thermally insulated central compartment. A common end seam on one side of the central compartment is utilized to attach a zippered access extensible end compartment. The extensible compartment is attached by a fully peripheral zipper or slide fastener which exposes a collapsed and extensible sleeve which, in turn, has a slide fastener or access zipper adjacent the end wall thereof such that the end wall can be flapped outward to permit full access to the extended sleeve which defines a substantial and elongated end compartment adjacent one side of the central compartment.

On the other side of the central compartment, affixed by another common seam is a fixed dimension second end compartment which has a zippered access means or slide fastener extending partially around the periphery thereof and which is attached to the thermally insulated central compartment by a common seam which also serves as a hinge line for a zippered top closure of the central compartment.

On the end walls of the end compartments are provided coupling rings which cooperate with snap swivels on the opposite ends of a shoulder carry strap. The carry strap is adjustable by a means of a conventional buckle arrangement to convert the bag from a hand carried mode to a shoulder carried mode as desired. The hand carried mode is enhanced by the fact that the loops for hand carrying are in a sling configuration completely supporting the central thermally insulated compartment of the bag to enhance its durability.

Two coupling rings are provided on one end surface, preferably on the end wall of the extensible end compartment, such that the snap swivels may be selectively positioned on that end wall to assist in taking up excess shoulder strap dimensions when the bag is in a fully closed minimum dimension condition and the hand carry mode. Furthermore, the shoulder strap can be fastened to these two coupling rings in the provision of a tote bag configuration.

The utility bag of the present invention by virtue of its unique construction has a plurality of uses such as a picnic bag for hot or cold food, a beach bag, a camera bag, a diaper bag, etc.

DETAILED DESCRIPTION OF THE DRAWINGS

Referring in detail to the drawings and with particular reference to FIGS. 1–7, the utility bag 10 of the present invention is illustrated in FIGS. 1, 2, 3, 5, 6, and 7, in an unexpanded condition. This bag 10 includes an extensible end compartment A, an insulated compartment B and a second end compartment C joined together at seams 12A and 12B, respectively, by machine stitchings 14A and 14B. Hand carrying loops 16A and 16B for carrying the bag 10 are anchored by pairs of crossed stitches 18 to the side walls BS of the central compartment B, as illustrated for one carry loop 16A in FIG. 1, at a position adjacent the top BP of the said central compartment B. A second set of pairs of crossed stitches 20 is provided to anchor the leg of each of the carry loops 16A and 16B adjacent the bottom of the side walls BS right at the point at which the side walls turn under the compartment B. The central side walls BS turn under the central compartment B to form bottom panels BB which are joined at a longitudinal central axis of the bag 10 in a seam 22. Further, each of the carry loops 16A, 16B extend to that central seam 22 and are maintained in place by appropriate stitches 24 adjacent to seam 22. As desired, the carry loops may also be adhesively secured or stitched through into the side walls BS and the bottom panels BB.

There are two end compartments A and C in the utility bag 10 of the present invention with the second end compartment C consisting of a collapsible compartment of a fixed size determined by an annular peripheral wall CS which includes, across the entire top surface thereof and portions of the side surfaces, a zipper or other slide fastener 26 for providing access to the second end compartment C.

The bottom most portion of the annular sidewall section CS has a longitudinally disposed center seam 22A which is in alignment with the center seam 22 of the central compartment B and substantially an extension thereof, the two said seams abutting on opposite sides of the common seam 12B which separates the second end compartment C from the central compartment B.

Figure 4:
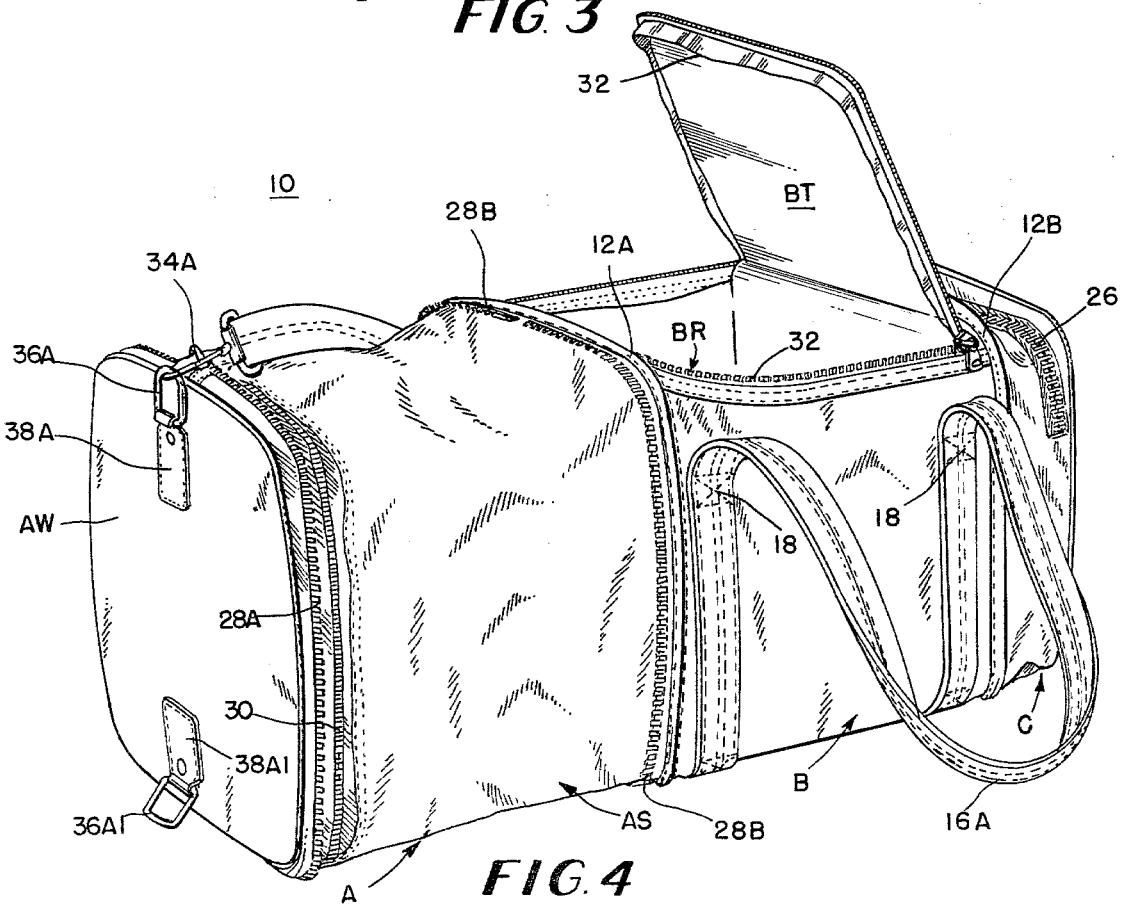
FIG. 4 is a perspective of the utility bag of the present invention in an extended position with the thermally insulated central compartment open.
Figure 5:
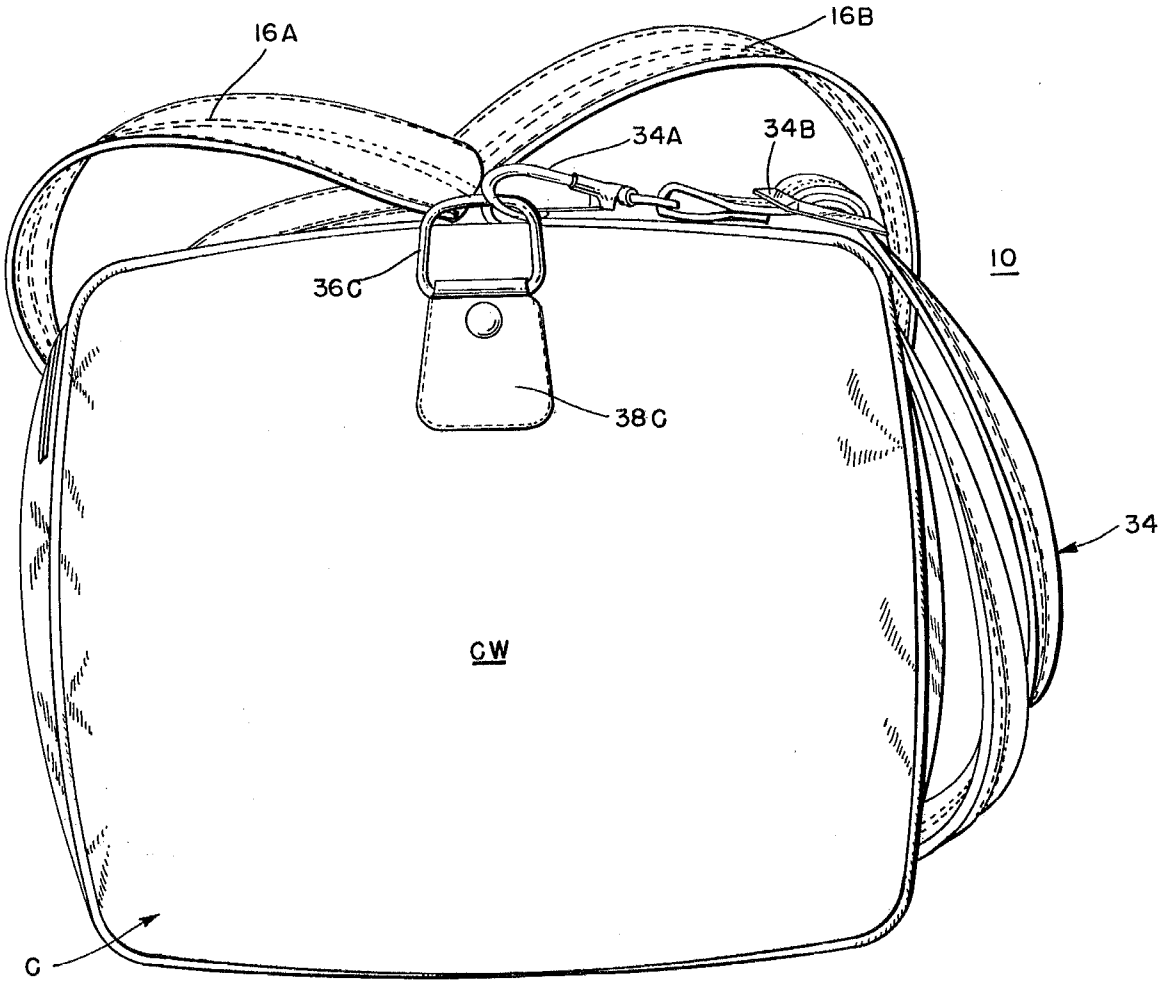
Figure 6:
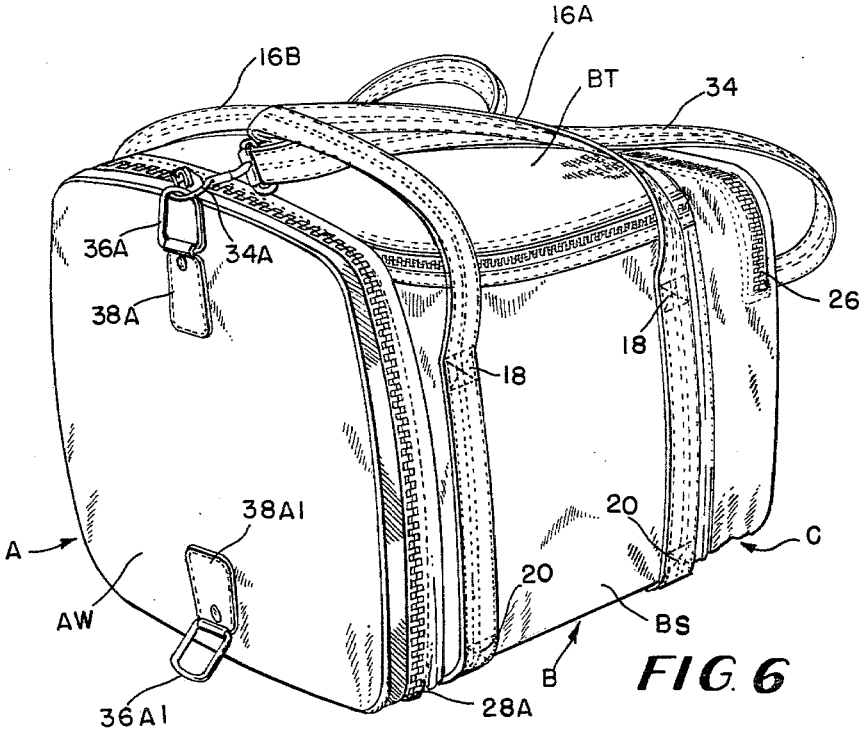
FIG. 6 is a perspective of the utility bag of the present invention in its most compact configuration.
Figure 7:
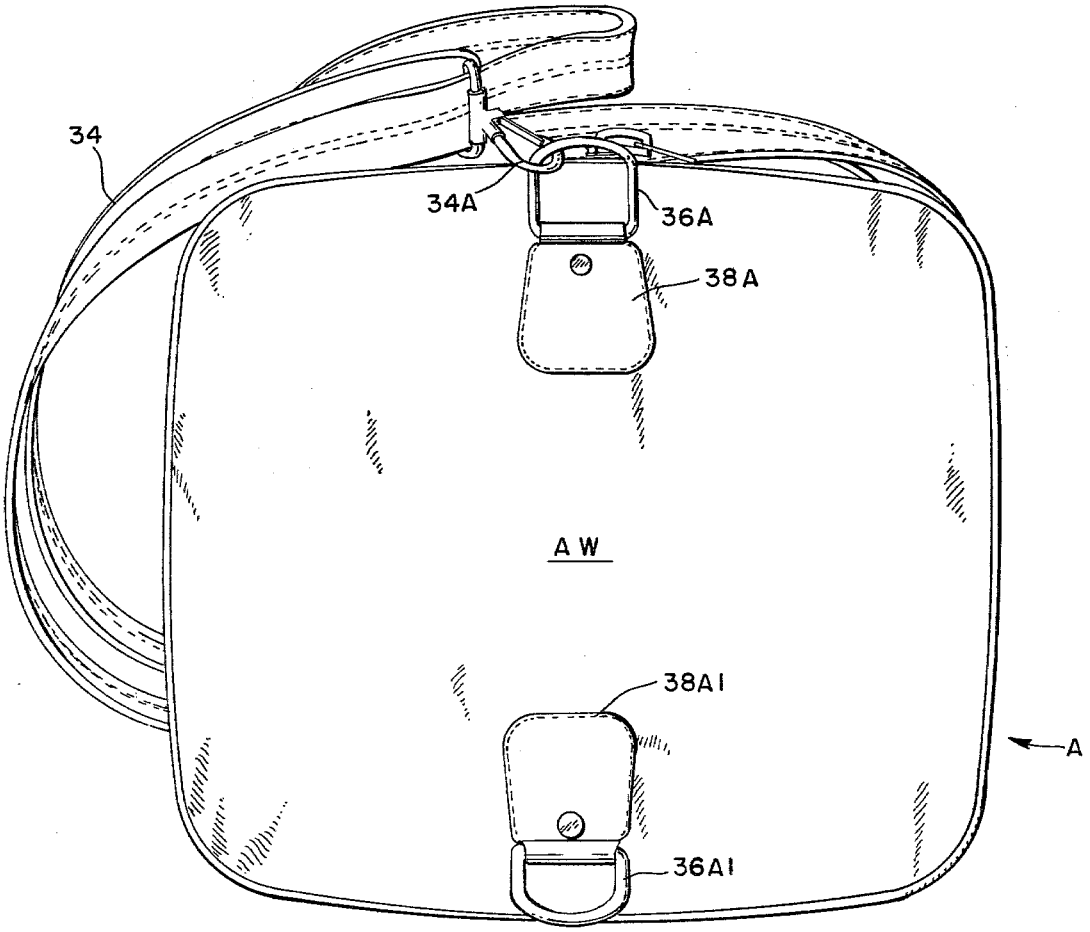
FIG. 7 is an end view of the utility bag of the present invention opposite of FIG. 5.

Referring to FIGS. 4 and 6, the extensible end compartment A is maintained in a collapsed condition by a circumferential zipper or slide fastener 28, which when fully disengaged around the entire periphery of the compartment A, exposes a collapsed sleeve member AS in which a second slide fastener or zipper 30 is provided immediately adjacent the end wall AW of the extensible compartment A. The tracks 28A and 28B of the circumferential zipper or slide fastener 28 respectively remain adjacent the end wall AW and the common seam 12A in the extended condition of the sleeve AS.

The second zipper of slide fastener 30 extends about the major portion of the circumference of the sleeve AS such that the end wall AW of the compartment may be dropped down in the manner of a flap to provide maximum access to the interior of the sleeve AS which serves as the extensible compartment A.

Figure 2:
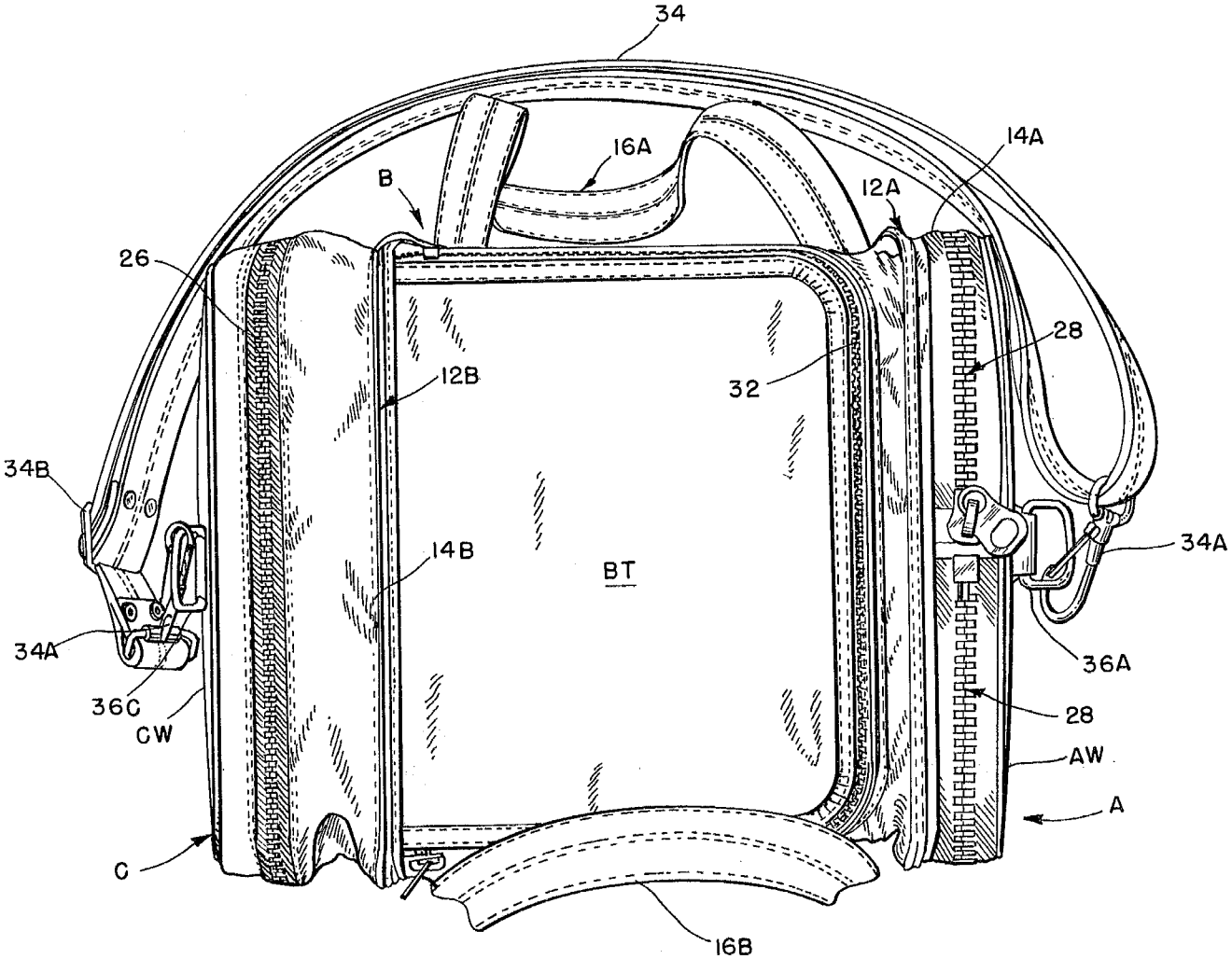
FIG. 2 is a top elevation of the utility bag of the present invention longitudinally reversed from that shown in FIG. 1.
Figure 3:
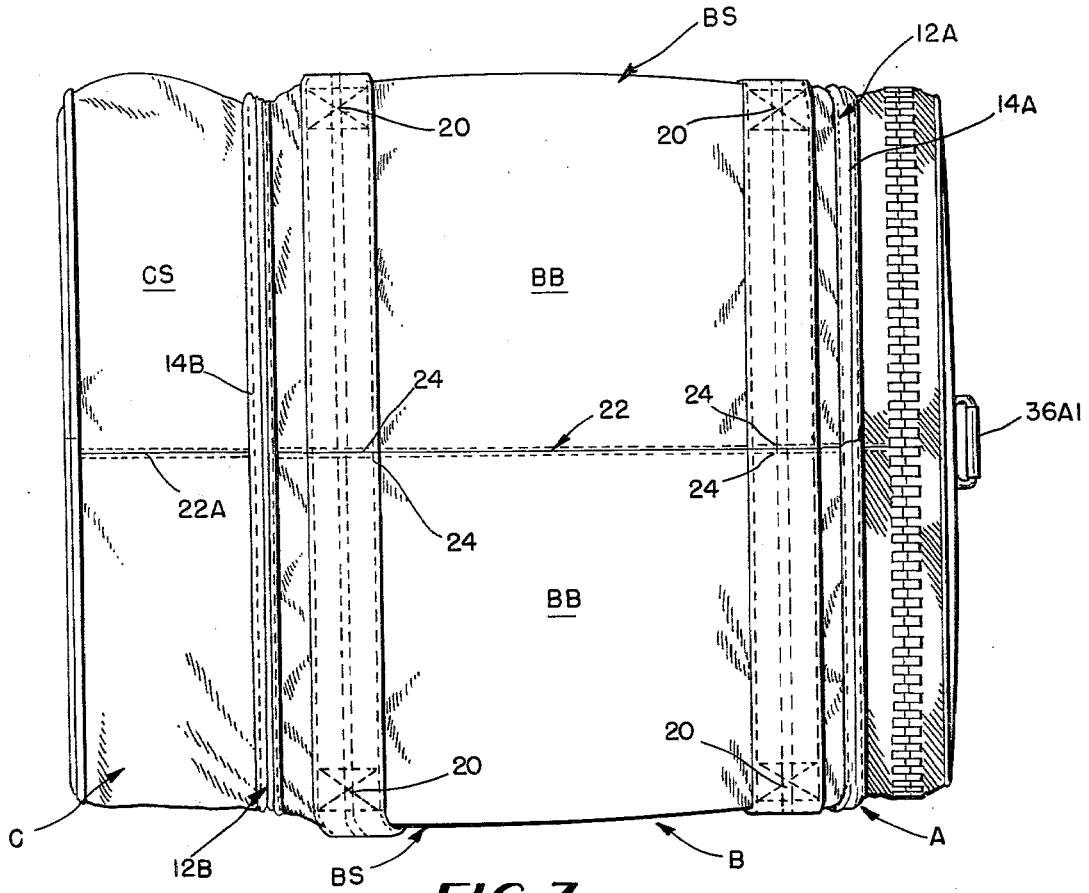
FIG. 3 is a bottom elevation of the utility bag of the present invention with the bag oriented in the configuration of FIG. 2.

Further, as best illustrated in FIGS. 2, 4, and 6, the lid portion BT of the central compartment B is provided with a three sided slide fastener or zipper 32 such that it will open completely to expose a substantially rectangular interior BR so that articles such as beverage cans and the like may be placed within the interior BR of the central compartment B for the purpose of keeping them cool or hot as the case may be. In this regard, the central compartment B is a thermally insulated compartment with each and every side thereof and the top BT thereof being insulated in a conventional manner such as by polyurethane foam or the like. The fourth side of the top BT of the central compartment B is commonly stitched into the seam 12B between the end compartment C and the central compartment B such that the top BT hinges about that seam. Additionally, except for the zippered closure BT, the central compartment B is substantially liquid tight.

A shoulder strap 34 having end snap swivels 34A and a central adjusting buckle 34B provides an adjustable sling configuration for converting the utility bag 10 of the present invention to a shoulder bag from a hand carried bag. The shoulder strap 34 is further illustrated with the snap swivels 34A attached to coupling rings 36A and 36C on the respective end walls AW and CW of the end compartments A and C.

The coupling rings 36A and 36B are held in place by stitched down loop and rivet structures 38A and 38C respectively.

A third coupling ring 36A1 is provided at the lower end of the end wall AW of the extensible compartment A where it is held in place by a stitched down loop and rivet assembly 38A1. Thus, when the compartment A is not in its extended position and the peripheral zipper or slide fastener 28 is fully closed, the shoulder strap 34 may be connected from the coupling ring 36C on the end wall CW of the second end compartment C over the top of the bag 10 and down into engagement with the third coupling ring 36A1 to thereby provide additional take-up for the shoulder strap 34 when the bag 10 is in a fully collapsed and hand carried mode.

This will prevent the shoulder strap 34 from flapping unnecessarily, thereby annoying the user of the bag 10.

As can be seen from the foregoing specification and drawings, the utility bag of the present invention serves many different functions such as carrying soft drinks in a central compartment B, game balls such as soccer balls and other athletic equipment or large items in the extensible end compartment A, and relatively smaller and foldable items such as extra clothing, towels, etc. in the second end compartment C.

When in the fully opened condition or extended condition of the extensible end compartment A, the shoulder strap can be elongated to its maximum extent with the snap swivel 34A adjacent to the end wall AW of the extensible compartment A being connected to the upper coupling ring 36A thereon to provide maximum leaway for insertion for the arm of the user beneath the shoulder strap to convert what can be a hand carried satchel by the straps 16A and 16B to a shoulder carried tote bag or the like.

Thus, the present invention provides a highly versatile and useful device which further provides clear and unobstructed end surfaces for the purpose of displaying advertising indicia.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

It is claimed:

1. A multiple compartment utility bag comprising in combination:

a central section having wall means defining a central compartment, said central compartment comprising a top wall, bottom wall, parallel side walls and parallel end walls; and first and second flexible end sections secured at the respective end walls of said central compartment such that said end walls of said central compartment form respective common walls between said central compartment and each of said first and second flexible end sections, each of said sections being further defined by a first end wall and one of said common end walls;

said first flexible end section comprising a collapsible and extensible first end compartment between said first end wall of said first flexible end section and said opposite common end wall of said central compartment, retained in its collapsed state by a fully peripheral slide fastener means, said end compartment housing a collapsed and extensible sleeve which, when said peripheral slide fastener means is in its opened state, is extendable so as to provide for the expansion of said flexible end section thereby defining an elongated end compartment adjacent said central compartment, said extensible sleeve having an access slide fastener means adjacent the first end wall of said first flexible section such that when said access fastener is in its opened state said first end wall can be opened outward so as to permit full access to said elongated end compartment;

said second flexible end section comprising a fixed dimension second collapsible end compartment including a slide fastener means extending across the entire top surface thereof and portions of the side surfaces providing access to said second end compartment;

said top wall of said central compartment including a slide fastener means therein defining a flap configuration for providing access to said central compartment.

2. The multiple compartment utility bag of claim 1 wherein said first end walls of said flexible end sections are of smooth configuration suitable for display of promotional indicia.

3. The multiple compartment utility bag of claim 1 further including hand carry strap means secured to said side walls of said central compartment for supporting said bag in a hand carry mode said strap means joinable across the top of said central compartment and shoulder strap means secured to said first end walls of said flexible end sections for supporting said bag in a shoulder carry mode.

4. The multiple compartment utility bag of claim 3 wherein said shoulder strap means comprises:

extensible strap means having first and second strap fasteners at opposite ends thereof; and at least one coupling ring means on each of said end walls of said flexible end sections for engagement with said snap fasteners.

5. The multiple compartment utility bag of claim 4 which further includes at least two coupling rings on one of said first end walls of said flexible end sections providing selective anchoring points for a corresponding snap fastener.

6. The utility bag of claim 3 wherein said hand carry strap means are arranged in a sling configuration around the bottom and side walls of said central section so as to reinforce said bottom and side walls of said central section to enhance its durability.

7. The utility bag of claim 1 wherein said central compartment is thermally insulated and/or substantially liquid tight.

8. A sports utility bag comprising in combination:

a thermally insulated central section defining a food and beverage storage compartment comprising a top wall, bottom wall, parallel side walls and parallel end walls;

first and second flexible end sections secured at the respective end walls of said central storage compartment such that said end walls of said storage compartment form respective common walls between said storage compartment and each of said first and second flexible end sections, each of said sections being further defined by a first end wall and one of said common end walls;

said first flexible end section comprising a collapsible and extensible first end storage compartment housing an entensible storage sleeve for sports paraphernalia, said storage sleeve comprising said first end wall defining the outermost extremity of said extensible storage sleeve, said sleeve being extended from said common side wall defining the extent of said central storage compartment to said end wall of said sleeve;

a fully peripheral slide fastener means for retaining said first extensible storage compartment in its collapsed state; and access means in said extensible storage sleeve providing for selective access to the interior of said extensible sleeve;

said second flexible end section comprising a fixed dimension second end compartment including a slide fastener means for providing access to said second end compartment.

9. The sports utility bag of claim 8 which further includes an access means defining an access flap in said thermally insulated section for providing access to said food and beverage storage compartment.

10. The sports utility bag of claim 8 further including hand carry strap means secured to said side walls of said thermally insulated central section for supporting said bag in a hand carry mode said strap means being joinable across the top of said central food and beverage storage compartment and shoulder strap means secured to said first end walls of said flexible end sections for supporting said bag in a shoulder carry mode.

11. The sports utility bag of claim 8 wherein said first end walls of said flexible end sections are of a smooth configuration suitable for a display of promotional indicia.

* * * * *